US005524782A

United States Patent [19]

Salemi

[11] Patent Number: 5,524,782

[45] Date of Patent: Jun. 11, 1996

[54] BOTTLE IMPROVEMENT FOR SHRINK BANDED CAPS

[75] Inventor: Tony Salemi, Ann Arbor, Mich.

[73] Assignee: Brit Corporation, Ypsilanti, Mich.

[21] Appl. No.: 182,622

[22] Filed: Jan. 13, 1994

Related U.S. Application Data

[63] Continuation of Ser. No. 926,833, Aug. 7, 1992, abandoned.

[51] Int. Cl.[6] ..... B65D 41/54; B65D 41/04; B65D 41/62

[52] U.S. Cl. ..... 215/246; 215/44; 215/220; 215/329; 215/901

[58] Field of Search ..... 215/31, 217, 218, 215/219, 220, 221, 246, 321, 329, 341, 44, 45

[56] References Cited

U.S. PATENT DOCUMENTS 4,562,930 1/1986 Lecinski, Jr. et al. ..... 215/31

*Primary Examiner*—Sue A. Weaver
*Attorney, Agent, or Firm*—James M. Diemen

[57] ABSTRACT

At the top of a bottle the circumferential bead lying between the cap fastening means and the neck is enlarged in diameter to better meet the enlarged diameter of an oversize cap such as a two piece "child-resistant" cap. The undercut below the bead forming the neck is greatly exaggerated. The circumferential bead is located lower on the top to better fit the extended skirt length of the outer cap of the two piece "child-resistant" cap. A circumferential shoulder is added above the bead to substantially match the skirt length and diameter of a standard cap. Regardless of whether a "child-resistant" cap or a standard cap is used, the plastic shrink-fit band tightly fits about the cap and over and underneath the circumferential bead. The loosening of either "child resistant" or standard cap will force the splitting of the band because the shrinkage of the band below the circumferential bead is considerably greater than the innate circumferential elongation of the shrunk plastic band material.

15 Claims, 2 Drawing Sheets

BOTTLE IMPROVEMENT FOR SHRINK BANDED CAPS

This is a continuation of application Ser. No. 07/926,833 filed on Aug. 7, 1992, and now abandoned.

BACKGROUND OF THE INVENTION

The field of the invention pertains to plastic bottles and, in particular, to bottles for human or animal food products and consumables and for pharmaceutical capsules, pills and tablets. Such bottles, after filling and capping, are equipped with a shrink-fit plastic band over the cap and into the neck of the bottle. The top of the bottle is formed with a circumferential small bead or ring located just below the spiral thread on the bottle. The plastic band is shrunk-fit over the cap and into the neck below the circumferential bead.

The purpose of the plastic band is to prevent uncapping of the bottle without breaking the band. The band normally splits as the cap is unscrewed from the bottle. Thus, any prior removal of the cap is immediately exposed. Unfortunately, the plastic band material possesses sufficient elongation that splitting is not assured when the cap is removed from bottles with standard small beads.

The likelihood of failure to split is further compounded by the use of both standard caps and oversize caps such as two piece "child-resistant" caps with the same size bottle necks and threads. The exterior diameter and skirt length of the two piece "child-resistant" cap are considerably larger than the standard cap. As a result the circumferential bead on the top lies within the skirt. The plastic shrink-fit band placed thereover is substantially, if not completely, ineffective in splitting when the cap is removed because the shrinkage below the skirt and circumferential bead is insufficient to tightly grasp the bead.

Illustrated in FIGS. 1, 2 and 3 below are three bottles with "child-resistant" caps thereon and plastic seals thereover. In FIG. 1 the circular bead has a diameter substantially equal to or smaller than the spiral thread. With the "child-resistant" cap the bead is under the skirt as shown. In FIG. 2 the bottle has a bead larger in diameter than the spiral thread, however, the bead is again covered by the skirt of the "child-resistant" cap. In FIG. 3 the bead includes a shoulder thereover with the bead just below the skirt of the "child-resistant" cap. The latter two bottles are of designs developed and currently available from applicant's company. The first bottle is conventional in the industry and the bead of the first bottle is inadequate to assure splitting of the plastic band upon opening of the cap.

Despite the use for many years of shrink-fit plastic bands as tamper indicators on bottles, the failure of the bands to split when the cap is removed continues to be an unsolved problem.

SUMMARY OF THE INVENTION

The circumferential bead below the spiral thread on the top of the bottle is extended in diameter to better meet the enlarged diameter of an oversize cap such as a two piece "child-resistant" cap and the undercut below the bead forming the neck is greatly exaggerated. The circumferential bead is located lower on the top to better fit the extended skirt length of the "child-resistant" cap. A circumferential shoulder is added above the bead to substantially match the skirt length and diameter of a standard cap. Thus, regardless of whether a "child-resistant" cap or a standard cap is used, the plastic shrink-fit band will tightly fit about the cap and over and underneath the circumferential bead into the neck. The loosening of either cap will force the splitting of the band because the shrinkage of the band below the circumferential bead into the neck is considerably greater than the circumferential elongation of the shrunk plastic band material.

Although the bottle is described in terms of a pharmaceutical bottle the new circumferential bead and neck configuration is applicable to non-pharmaceutical bottles where a shrink-fit band is used.

DESCRIPTION OF THE PREFERRED EMBODIMENTS

Figure 1:
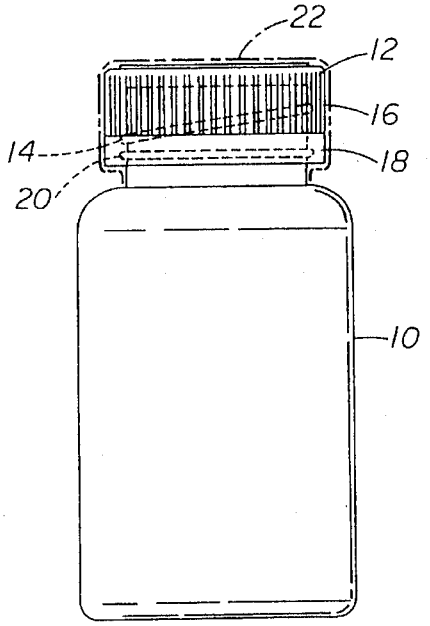
FIG 1 PRIOR ART
FIG. 1 illustrates in side view a pharmaceutical conventional small bead "prior-art" bottle with a "child-resistant" cap.

As shown in FIG. 1 a conventional pharmaceutical bottle 10 includes a top 12 having a thread 14 for attachment of a standard cap or a "child-resistant" cap 16 as shown. The relatively long skirt 18 of the "child-resistant" cap completely covers the circumferential bead 20. The bead outside diameter is substantially equal to the outside diameter of the thread 14. As a result the shrunk-fit plastic band 22 is not sufficiently stretched to split over the bead 20 when the cap 16 is removed. In practice the cap 16 and band 22 may sometimes be removed and reattached several times without splitting the band 22. The destroyed band indication of cap removal is thus thwarted.

Figure 2:
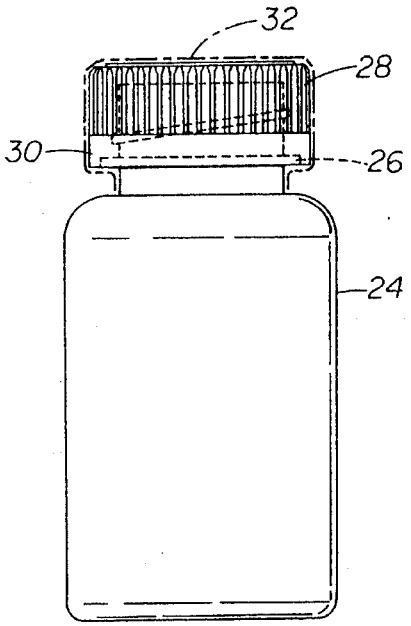
FIG 2 PRIOR ART
FIG. 2 illustrates in side view a pharmaceutical "prior-art" bottle currently available from applicant's company with a modified larger circumferential bead under the "child-resistant" cap.

In FIG. 2 a bottle 24 offered by applicant's company is shown with an enlarged circumferential bead 26. This bottle 24 is normally offered with a standard cap, however, it can be fitted with a "child-resistant" cap 28 as shown. The extended skirt 30 of the cap 28 covers the bead 26 compromising the ability of the bead 26 to split a plastic band 32 when the cap 28 is removed.

Figure 3:
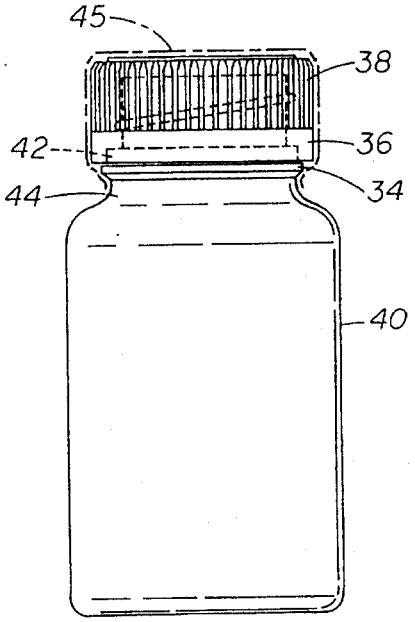
FIG 3 PRIOR ART
FIG. 3 illustrates in side view a pharmaceutical "prior-art" bottle currently available from applicant's company with a modified circumferential bead and a larger diameter neck just below the bead.

FIG. 3 illustrates a bottle offered by applicant's company to improve upon the appearance of bottles illustrated in FIGS. 1 and 2 when the "child-resistant" cap is used. Aesthetic appeal is an important factor in the sale of bottles to the ultimate sellers of the products eventually sold in the bottles. The bead on the top of the bottle lends a pleasing finished appearance to bottles with a standard cap. However, with a "child-resistant" cap the pleasing finished appearance is lost with the bead hidden under the cap.

Thus, the bottle in FIG. 3 provides a bead 34 below the skirt 36 of the "child-resistant" cap 38 on the bottle 40. For aesthetic appearance with a standard cap a shoulder 42 is provided above the bead 34. And the neck 44 below the bead 34 is enlarged in diameter and smoothly rounded giving an appearance of strength to the bottle 40 with the "child-resistant" cap 38 attached. Here again the band 45 cannot shrink-fit into the neck 44 an amount sufficient to assure that the band will split when the cap 38 is removed.

Figure 4:
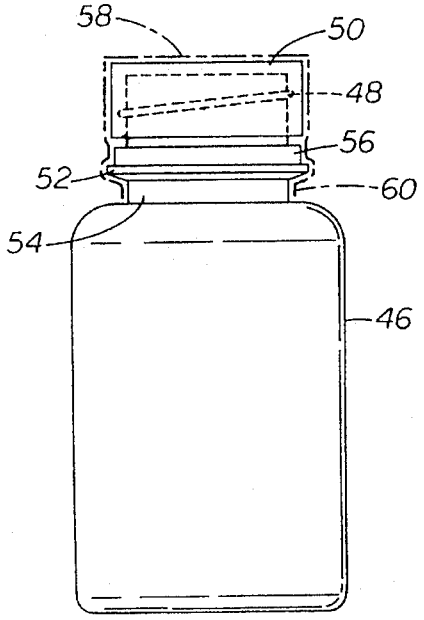
FIG. 4 illustrates in side view a new pharmaceutical bottle with a standard cap threaded thereon.
Figure 6:
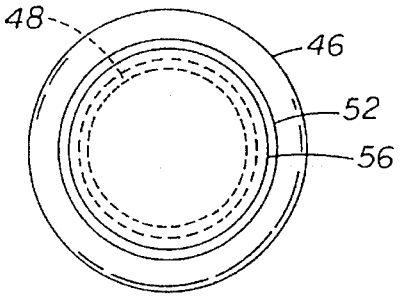
FIG. 6 is a top view of the pharmaceutical bottle of FIG. 4 with the top open.

Illustrated in FIG. 4 and FIG. 6 is the new modified pharmaceutical bottle 46 having a product containing portion and a threaded top 48 to which is attached a cap 50. As shown the cap 50 is a standard threaded cap. Between the threaded top 48 and the balance of the bottle 46 is a pronounced circumferential bead 52 in the form of a flange. Below the bead 52 is a greatly undercut neck 54. Preferably the maximum diameter of the undercut neck is equal to or less than the top diameter excluding the cap attachment means. Above the bead 52 a circumferential shoulder 56 is formed that substantially matches the diameter of the standard cap 50. The shoulder 56 extends upwardly to fill the gap between the bead 52 and the skirt of the standard cap 50. Shrunk-fit to the cap 50 and bottle 46 is the plastic band 58 as indicated by the ghosted outline. As shown, the plastic band 58 extends deeply under the bead 52 as shown at 60. Because the plastic band 58 extends deeply under the bead 52 removal of the cap 50 forces the shrink-fit band portion 60 to stretch beyond its limit of elongation and to split. Thus, the undercut of the neck 54 must be sufficient to enable the band 58 to wrap tightly under the bead 52.

Figure 5:
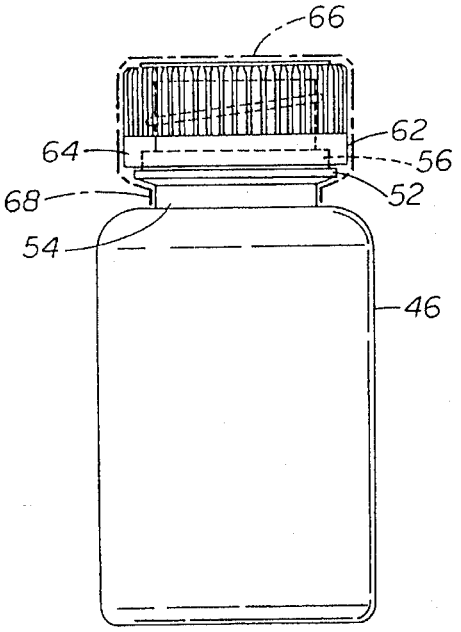
FIG. 5 illustrates in side view the pharmaceutical bottle of FIG. 4 with a "child-resistant" cap threaded thereon.

In FIG. 5 the pharmaceutical bottle 46 is shown with a "child-resistant" cap 62 screwed thereon. The overcap skirt 64 of the "child-resistant" cap 62 extends substantially lower than the standard cap 50 and substantially covers the shoulder 56 above the bead 52. The two piece "child resistant" cap 62 also is larger in diameter than the bead 52, however, the bead shows beneath the cap. Nevertheless, with the deep undercut neck 54 the plastic band 66 extends over the bead 52 and deeply into the undercut as shown at 68. Because the shrink-fit plastic band 66 extends deeply under the bead 52 into the undercut neck 54, the plastic band material is stretched beyond its circumferential elongation upon opening of the cap 62 and splits to reveal tampering. A shallow undercut neck 54 or insufficient bead 52 diameter would allow the plastic band material to stretch and slide over the flange without splitting as noted above. Thus, the deep undercut neck and oversize bead assure that the band splits upon opening of the cap regardless of which cap is used.

Figure 7:
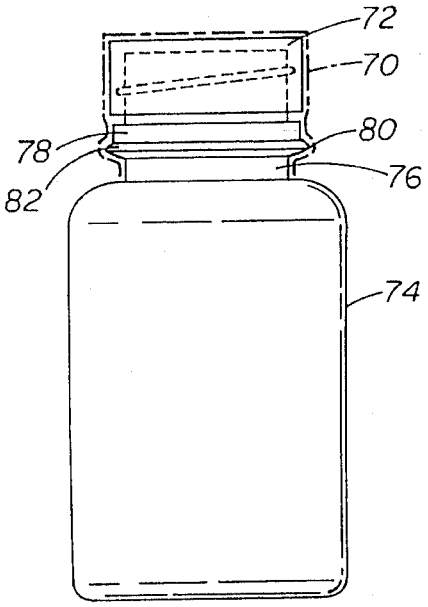
FIG. 7 illustrates in partial side view a new pharmaceutical bottle with a chamfered bead.

Illustrated in FIG. 7 is a further modification to assist in assuring that the band 70 is properly positioned over a standard cap 72 and bottle 74 just prior to the heating step that causes the band 70 to shrink tightly over the cap 72 and into the neck 76. The upper circumferential surface between the shoulder 78 and the outermost periphery of the bead 80 is sloped, rounded or chamfered 82 at about 45° to the axis of the bottle. The chamfer 82 causes a downwardly descending unshrunk band to smoothly slide over the outermost periphery of the bead 80 in automatic capping and banding machinery. The chamfer also assists in the hand application of unshrunk bands. Mispositioned or misshapen bands are therefore less likely to "catch" on the flange shaped bead 52 of FIG. 4. The 45° chamfer is preferred but, depending upon the band material and bottle material, a different slope may be selected.

In summary the same bottle with the new bead and neck combination disclosed above provides assurance that the band will split regardless of which cap and band, standard or "child resistant", is applied to the bottle.

I claim:

1. A bottle comprising a product containing portion, a neck extending from the product containing portion and having a diameter, and a substantially cylindrical top having a diameter and extending upwardly from the neck, cap attachment means formed on the top, a cylindrical shoulder below the cap attachment means, said shoulder having a diameter, a flange below the shoulder, said flange being continuous with the shoulder and said flange having a flat upper surface, said shoulder having a diameter substantially equal to the outside skirt diameter of a cap having an interiorly threaded skirt and located below the maximum extent of the interiorly threaded skirt when the cap having the interiorly threaded skirt in installed on the bottle and said shoulder substantially filling the height between the flange and the interiorly threaded skirt, said flange having a outermost diameter substantially greater than the shoulder diameter and located below the maximum extent of a longer skirt of a threaded two-piece cap when the threaded-two-piece cap is installed on the bottle, and the neck lying below the flange, the neck diameter having a maximum not more that the diameter of the top above the shoulder and excluding the cap attachment means.

2. The bottle of claim 1 wherein the difference between the neck circumference and the flange outermost circumference exceeds the maximum circumferential elongation of a plastic band shrunk-fit over the flange and into the neck.

3. The bottle of claim 1 wherein the difference between the neck circumference and the outside skirt circumference of the threaded two-piece cap exceeds the maximum circumferential elongation of a plastic band shrunk fit over the threaded two-piece cap and into the neck.

4. The bottle of claim 1 wherein the flange upper surface between the shoulder and the flange outermost diameter is chamfered to permit a shrink fit band to smoothly descend over the flange.

5. The bottle of claim 1 wherein the flange upper surface is chamfered to permit a shrink fit band to smoothly descend over the flange.

6. The bottle of claim 1 including a cap thereon having an interiorly threaded skirt and a shrink band installed thereover, the diameter of the interiorly threaded skirt of the cap substantially equal to the diameter of the shoulder.

7. The bottle of claim 1 including a threaded two-piece cap thereon and a shrink band installed thereover, the flange located below the skirt of the threaded two-piece cap.

8. A bottle comprising a product containing portion, a neck extending from the product containing portion and having a diameter and a substantially cylindrical top having a diameter and extending upwardly from the neck, cap attachment means formed on the top, a cylindrical shoulder below the cap attachment means, said shoulder having a diameter, a flange below the shoulder, said flange being contiguous with the shoulder and said flange having a flat upper surface, said shoulder located below the maximum extent of an interiorly threaded skirt of a cap having the interiorly threaded skirt when the cap is installed on the bottle, and said shoulder substantially filling the height between the flange and the interiorly threaded skirt, said flange having an outermost diameter substantially greater than the shoulder diameter and located below the maximum extent of a longer skirt of a threaded two-piece cap when the threaded two-piece cap is installed on the bottle, and the neck lying below the flange, the difference between the circumference of the neck and the maximum circumference of the flange exceeding the maximum circumferential elongation of a plastic band shrunk-fit over the flange and into the neck and the neck diameter not exceeding the diameter of the top about the shoulder excluding the cap attachment means.

9. The bottle of claim 8 wherein the flange upper surface is chamfered to permit a shrink fit band to smoothly descend over the flange.

10. The bottle of claim 8 including a cap thereon having an interiorly threaded skirt band installed thereover, the diameter of the interiorly threaded skirt of the cap substantially equal to the diameter of the shoulder.

11. The bottle of claim 8 including a threaded two-piece cap thereon and a shrink band installed thereover, the flange located below the skirt of the threaded two-piece cap.

12. A bottle comprising a product containing portion, a neck extending from the product containing portion and having a diameter and a substantially cylindrical top having a diameter and extending upwardly from the neck, cap attachment means formed on the top, a cylindrical shoulder below the cap attachment means, said shoulder having a diameter, a flange below the shoulder, said flange being contiguous with the shoulder and, said flange having a flat upper surface, said shoulder located below the maximum extent of an interiorly threaded skirt of a cap having the interiorly threaded skirt when the cap is installed on the bottle, and said shoulder substantially filling the height between the flange and the interiorly threaded skirt, said flange having an outermost diameter substantially greater than the shoulder diameter and located below the maximum extent of a longer skirt of a threaded two-piece cap when the threaded two-piece cap is installed on the bottle, and the neck lying below the flange, the difference between the circumference of the neck and the circumference of the longer skirt of the threaded two-piece cap exceeding the maximum circumferential elongation of a plastic band shrunk fit over the flange and into the neck and the neck diameter not exceeding the diameter of the top above the shoulder excluding the cap attachment means.

13. The bottle of claim 12 wherein the flange upper surface is chamfered to permit a shrink fit band to smoothly descend over the flange.

14. The bottle of claim 12 including a cap thereon having an interiorly threaded skirt and a shirk band installed thereover, the diameter of the interiorly threaded skirt of the cap substantially equal to the diameter of the shoulder.

15. The bottle of claim 12 including a threaded two-piece cap thereon and a shirk band installed thereover, the flange located below the skirt of the threaded two-piece cap.

* * * * *